US011043765B2

(12) United States Patent
Osaki et al.

(10) Patent No.: US 11,043,765 B2
(45) Date of Patent: Jun. 22, 2021

(54) MULTIPOLAR CONNECTOR

(71) Applicant: Murata Manufacturing Co., Ltd., Kyoto (JP)

(72) Inventors: Yoshihiro Osaki, Nagaokakyo (JP); Chikara Uratani, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 16/796,817

(22) Filed: Feb. 20, 2020

(65) Prior Publication Data

US 2020/0194916 A1 Jun. 18, 2020

Related U.S. Application Data

(60) Division of application No. 15/795,296, filed on Oct. 27, 2017, now Pat. No. 10,573,987, which is a (Continued)

(30) Foreign Application Priority Data

May 1, 2015 (JP) ..... 2015-094076

(51) Int. Cl.
*H01R 12/79* (2011.01)
*H01R 12/71* (2011.01)
(Continued)

(52) U.S. Cl.
CPC ..... *H01R 12/79* (2013.01); *H01R 12/707* (2013.01); *H01R 12/71* (2013.01); *H01R 12/716* (2013.01);
(Continued)

(58) Field of Classification Search
CPC .... H01R 12/79; H01R 12/707; H01R 12/716; H01R 12/73; H01R 12/77; H01R 13/05
(Continued)

(56) References Cited

U.S. PATENT DOCUMENTS 5,030,140 A 7/1991 Sugiyama
5,326,282 A 7/1994 Igarashi et al.
(Continued)

FOREIGN PATENT DOCUMENTS

CN 102623841 A 8/2012
JP H03-013681 U 2/1991
(Continued)

OTHER PUBLICATIONS

An Office Action mailed by the Chinese Patent Office dated Dec. 28, 2018, which corresponds to Chinese Patent Application No. 201680024963. 2 and is related to U.S. Appl. No. 15/795,296 with English language translation.
(Continued)

*Primary Examiner* — Tho D Ta
(74) *Attorney, Agent, or Firm* — Studebaker & Brackett PC

(57) ABSTRACT

A multipolar connector capable of easily assembling components thereof without requiring high positional accuracy for portions of the components that are to be fixed to each other. A multipolar connector is a multipolar connector for use in electrically connecting circuit boards to each other. The multipolar connector includes an external terminal that is fixed to a circuit board, an insulating member that is fixed to the external terminal, and internal terminals that are respectively fitted to grooves, which are formed in the insulating member, so as to be partially exposed through the insulating member. The insulating member is placed such that the bottom surface thereof is in contact with an outer frame portion of the external terminal and fixed to the external terminal as a result of the top surface thereof being pressed by bending portions of the external terminal toward the outer frame portion.

8 Claims, 8 Drawing Sheets

Related U.S. Application Data continuation of application No. PCT/JP2016/061756, filed on Apr. 12, 2016.

(51) Int. Cl.

| | |
|---|---|
| ***H01R 12/77*** | (2011.01) |
| ***H01R 12/73*** | (2011.01) |
| ***H01R 12/70*** | (2011.01) |
| ***H01R 13/05*** | (2006.01) |
| *H01R 13/6581* | (2011.01) |

(52) U.S. Cl.
CPC ..... *H01R 12/73* (2013.01); *H01R 12/77* (2013.01); *H01R 13/05* (2013.01); *H01R 13/6581* (2013.01)

(58) Field of Classification Search
USPC ..... 439/660
See application file for complete search history.

(56) References Cited

U.S. PATENT DOCUMENTS

| | | | | |
|---|---|---|---|---|
| 6,585,532 | B2 * | 7/2003 | Uratani | H01R 24/46 200/51.1 |
| 7,309,238 | B2 * | 12/2007 | Yang | H01R 13/2442 439/71 |
| 7,699,662 | B1 * | 4/2010 | Lee | H01R 24/62 439/660 |
| 7,901,218 | B2 * | 3/2011 | Sato | H01R 13/20 439/74 |
| 8,668,527 | B2 * | 3/2014 | Zhang | H01R 13/6594 439/660 |
| 8,845,339 | B2 | 9/2014 | Ono | |
| 9,331,410 | B2 | 5/2016 | Obikane et al. | |
| 9,450,340 | B2 | 9/2016 | Uratani et al. | |
| 9,666,963 | B2 * | 5/2017 | He | H01R 12/7088 |
| 9,997,852 | B2 | 6/2018 | Chen | |
| 2006/0040559 | A1 | 2/2006 | Zhang et al. | |
| 2010/0221928 | A1 | 9/2010 | Sato et al. | |
| 2013/0012039 | A1 | 1/2013 | Nose et al. | |
| 2013/0012074 | A1 | 1/2013 | Mashiyama et al. | |

FOREIGN PATENT DOCUMENTS

| | | | |
|---|---|---|---|
| JP | 2541256 | Y2 | 7/1997 |
| JP | 3112259 | U | 8/2005 |
| JP | 2012-156090 | A | 8/2012 |
| JP | 2012-252785 | A | 12/2012 |

OTHER PUBLICATIONS

International Search Report issued in PCT/JP2016/061756; dated Jul. 5, 2016.
Written Opinion issued in PCT/JP2016/061756; dated Jul. 5, 2016.

* cited by examiner

MULTIPOLAR CONNECTOR

CROSS REFERENCE TO RELATED APPLICATIONS

This application is a Divisional of U.S. patent application Ser. No. 15/795,296 filed Oct. 27, 2017, and claims benefit of priority to Japanese Patent Application 2015-094076 filed May 1, 2015, and to International Patent Application No. PCT/JP2016/061756 filed Apr. 12, 2016, the entire content of which is incorporated herein by reference.

TECHNICAL FIELD

The present disclosure relates to a multipolar connector, and more particularly to a multipolar connector used for electrically connecting circuit boards to each other.

BACKGROUND

A small-sized multipolar electrical connector described in Japanese Registered Utility Model No. 2541256 is a known example of a multipolar connector used for electrically connecting circuit boards to each other. This type of multipolar connector (hereinafter referred to as a multipolar connector of the related art) includes an insulating block in which internal terminals called contacts are arranged and a metal shell surrounding the insulating block. Here, a metal shell of a multipolar connector of the related art is attached to an insulating block by inserting a plurality of latch protrusions formed at the lower end of a side surface of the insulating block into a plurality of latch holes formed at the lower end of the metal shell. In addition, in a multipolar connector of the related art, in order to accommodate a force that is applied to a metal shell when connecting circuit boards to each other, a center portion of an upper end portion of the metal shell is bent toward the insulating block so as to be fitted into a recess formed in the top surface of the insulating block.

As described above, in a multipolar connector of the related art, a metal shell and an insulating block are fixed to each other at a plurality of positions, such as latch holes and a recess, in order to attach the metal shell to the insulating block and to improve the strength of the multipolar connector. In the case of fixing components to each other at a plurality of positions as described above, in order to securely engage portions of the components to be fixed to each other, high positional accuracy is required for the portions. Accordingly, in a multipolar connector of the related art, since high positional accuracy is required for a portion of a metal shell and a portion of an insulating block that are to be fixed to each other, the manufacturing process becomes complex, and the manufacturing costs increase.

SUMMARY

Technical Problem

It is an object of the present disclosure to provide a multipolar connector capable of easily assembling components thereof without requiring high positional accuracy for portions of the components that are to be fixed to each other.

Solution to Problem

A multipolar connector according to an aspect of the present disclosure is a multipolar connector for use in electrically connecting a first circuit board and a second circuit board to each other. The multipolar connector includes an external terminal that is fixed to the first circuit board, an insulating member that is placed such that a first surface of the insulating member is in contact with an outer frame portion of the external terminal, the insulating member being fixed to the external terminal as a result of a second surface of the insulating member being pressed by a bending portion of the external terminal toward the outer frame portion, and an internal terminal that is fitted to a groove formed in the insulating member such that a portion of the internal terminal is exposed through the insulating member. The bending portion is a portion that extends from the outer frame portion and that is bent toward the second surface.

In the multipolar connector according to the aspect of the present disclosure, the insulating member is placed such that the first surface of the insulating member is in contact with the outer frame portion of the external terminal, and the insulating member is fixed to the external terminal as a result of the second surface of the insulating member being pressed by the bending portion of the external terminal toward the outer frame portion. Such a structure is simpler than that of a multipolar connector of the related art, and when performing assembly, high positional accuracy is not required for a portion of the insulating member and a portion of the external terminal that are to be fixed to each other.

Advantageous Effects of Disclosure

According to the present disclosure, components can be easily assembled without requiring high positional accuracy for portions of the components that are to be fixed to each other.

DETAILED DESCRIPTION

In a multipolar connector 10, a direction in which an insulating member 16 is mounted on an external terminal 12 will hereinafter be referred to as the vertical direction. The direction in which a plurality of internal terminals 14*a* to 14*c* of the multipolar connector 10 are aligned will hereinafter be referred to as the transverse direction, and the direction perpendicular to the vertical direction and the transverse direction will hereinafter be referred to as the depth direction. The direction perpendicular to the vertical direction, the direction including the transverse direction and the depth direction, will hereinafter be referred to as the horizontal direction.

(Configuration of Multipolar Connector, See FIGS. 1 to 8)

Figure 1:
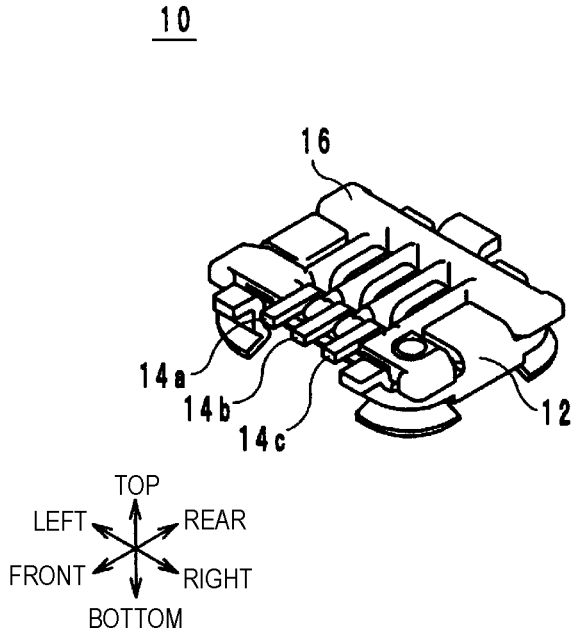
FIG. 1 is an external perspective view of a multipolar connector according to an embodiment of the present disclosure.
Figure 2:
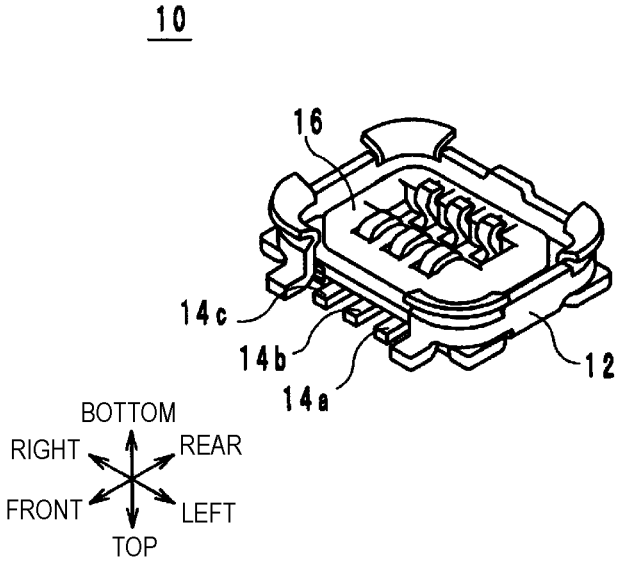
FIG. 2 is an external perspective view of the multipolar connector according to the embodiment.

The multipolar connector 10 according to an embodiment of the present disclosure is mounted onto, for example, a flexible wiring board including wiring lines or a circuit board such as a printed circuit board and includes, as illustrated in FIG. 1 and FIG. 2, the external terminal 12, the plurality of internal terminals 14*a* to 14*c*, and the insulating member 16.

Figure 3:
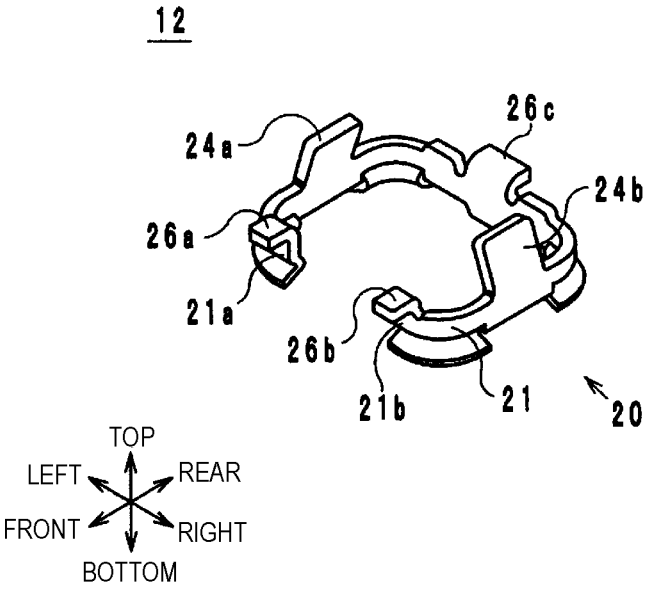
FIG. 3 is an external perspective view of an outer frame portion according to the embodiment.

The external terminal 12 is a conductor connected to a ground potential. The external terminal 12 is fabricated by bending a single metal plate made of, for example, phosphor bronze. As illustrated in FIG. 3, the external terminal 12 includes an outer frame portion 20, bending portions 24*a* and 24*b*, and connecting portions 26*a* to 26*c*.

Figure 4:
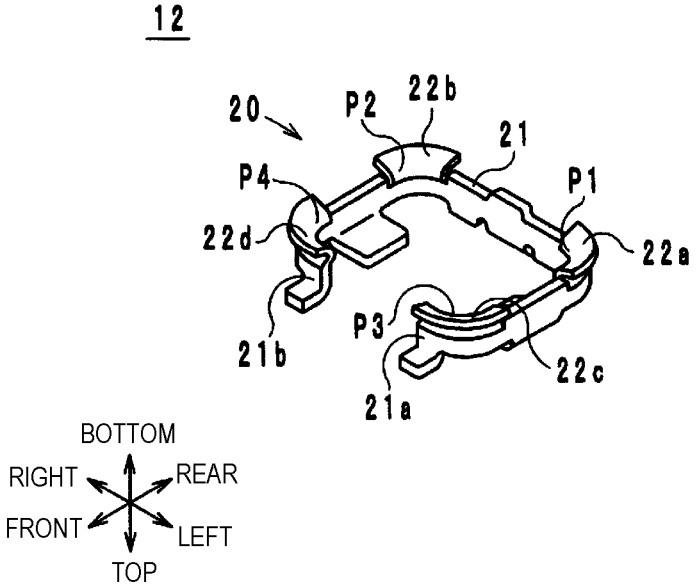
FIG. 4 is an external perspective view of the outer frame portion according to the embodiment.

As illustrated in FIG. 4, the outer frame portion 20 includes a framework portion 21 and guide portions 22*a* to 22*d*. The framework portion 21 is a belt-shaped conductor that extends around a central axis extending in the vertical direction. When viewed from above, the framework portion 21 has an annular shape that follows the outer edge of a rectangle having the front and rear long sides extending in the transverse direction. However, a portion of the front long side of the framework portion 21 is cut out, and thus, the framework portion 21 does not have a perfect annular shape. An end portion located on the left side of the cutout portion of the framework portion 21 will hereinafter be referred to as an end portion 21*a*, and an end portion located on the right side of the cutout portion will hereinafter be referred to as an end portion 21*b*. Note that, when the framework portion 21 is viewed from above, the four corner portions of the rectangle formed by the framework portion 21 are rounded.

The guide portion 22*a* is provided at the lower end of the left rear corner of the framework portion 21. The guide portion 22*a* has a fan-like shape extending downward and outward from the rectangle formed by the framework portion 21. Here, when the cross section of the guide portion 22*a* is viewed in the horizontal direction, the guide portion 22*a* extends toward the inside of the rectangle formed by the framework portion 21 and then extends downward while gently curving outward. As a result, a projecting portion P1 that projects toward the inner periphery side is formed at the left rear corner of the outer frame portion 20.

The guide portion 22*b* is provided at the lower end of the right rear corner of the framework portion 21. The guide portion 22*b* has a fan-like shape extending downward and outward from the rectangle formed by the framework portion 21. Here, when the cross section of the guide portion 22*b* is viewed in the horizontal direction, the guide portion 22*b* extends toward the inside of the rectangle formed by the framework portion 21 and then extends downward while gently curving outward. As a result, a projecting portion P2 that projects toward the inner periphery side is formed at the right rear corner of the outer frame portion 20.

The guide portion 22*c* is provided at the lower end of the left front corner of the framework portion 21. The guide portion 22*c* has a fan-like shape extending downward and outward from the rectangle formed by the framework portion 21. Here, when the cross section of the guide portion 22*c* is viewed in the horizontal direction, the guide portion 22*c* extends toward the inside of the rectangle formed by the framework portion 21 and then extends downward while gently curving outward. As a result, a projecting portion P3 that projects toward the inner periphery side is formed at the left front corner of the outer frame portion 20.

The guide portion 22*d* is provided at the lower end of the right front corner of the framework portion 21. The guide portion 22*d* has a fan-like shape extending downward and outward from the rectangle formed by the framework portion 21. Here, when the cross section of the guide portion 22*d* is viewed in the horizontal direction, the guide portion 22*d* extends toward the inside of the rectangle formed by the framework portion 21 and then extends downward while gently curving outward. As a result, a projecting portion P4 that projects toward the inner periphery side is formed at the right front corner of the outer frame portion 20.

As illustrated in FIG. 3, the bending portion 24*a* is connected to the upper end of the left short side of the framework portion 21. When the insulating member 16, which will be described later, is mounted on the outer frame portion 20, the bending portion 24*a* is bent toward the inside of the rectangle formed by the framework portion 21, that is, to the right side.

The bending portion 24*b* is connected to the upper end of the right short side of the framework portion 21. When the insulating member 16, which will be described later, is mounted on the outer frame portion 20, the bending portion 24*b* is bent toward the inside of the rectangle formed by the framework portion 21, that is, to the left side.

The connecting portion 26*a* is a portion that projects frontward from the upper end of the end portion 21*a* of the framework portion 21 and that has a rectangular shape. The connecting portion 26*b* is a portion that projects frontward from the upper end of the end portion 21*b* of the framework portion 21 and that has a rectangular shape. The connecting portion 26*c* is provided at the center of the upper end of the rear long side of the framework portion 21. The connecting portion 26*c* is a portion that projects rearward from the upper end of the framework portion 21 and that has a rectangular shape.

Figure 5:
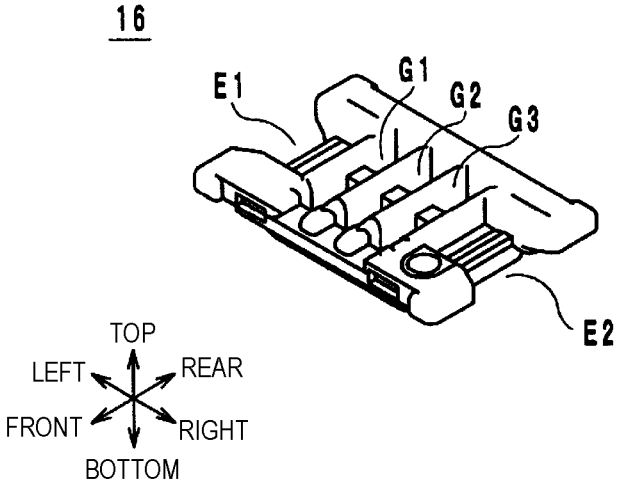
FIG. 5 is an external perspective view of an insulating member according to the embodiment.
Figure 6:
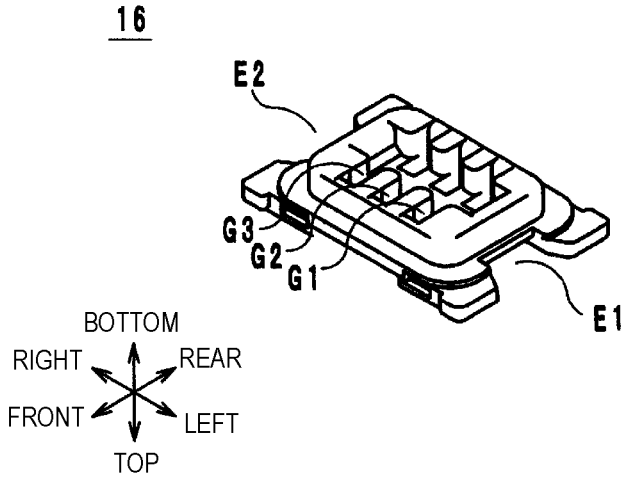
FIG. 6 is an external perspective view of the insulating member according to the embodiment.

The insulating member 16 is an insulating member that is placed and fixed onto the outer frame portion 20 and serves to insulate the outer frame portion 20 from the internal terminals 14*a* to 14*c* and hold the internal terminals 14*a* to 14*c*. As illustrated in FIG. 5 and FIG. 6, when viewed from above, the insulating member 16 has a substantially rectangular shape. However, a recess E1 is formed by cutting out a portion of the left side of the rectangle, which is formed by the insulating member 16, toward the inside of the insulating member 16, and a recess E2 is formed by cutting out a portion of the right side of the rectangle toward the inside of the insulating member 16. More specifically, the recesses E1 and E2 are formed by forming steps that reduce the thickness of the insulating member 16 in the vertical direction in the vicinity of the left and right sides of the rectangle formed by the insulating member 16. When the above-mentioned bending portions 24*a* and 24*b* are bent toward the inside of the insulating member 16, the bending portions 24*a* and 24*b* are fitted into upper portions of the recesses E1 and E2, respectively. By forming the recesses E1 and E2 in the insulating member 16 such that the bending portions 24*a* and 24*b* are partially fitted into the recesses E1 and E2, respectively, the height of the multipolar connector 10 can be reduced. Note that the steps formed of the recesses E1 and E2 in the top surface of the insulating member 16 are not necessary. In addition, a plurality of grooves G1 to G3 each extending in the depth direction are formed in the insulating member 16. The three grooves G1 to G3 are arranged in the order of the groove G1, the groove G2, and the groove G3 from the left side to the right side. Note that the grooves G1 to G3 extend through the insulating member 16 in the vertical direction.

Figure 7:
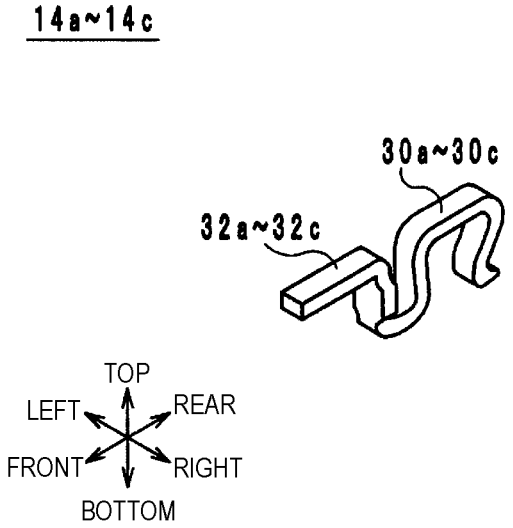
FIG. 7 is an external perspective view of each of internal terminals according to the embodiment.
Figure 8:
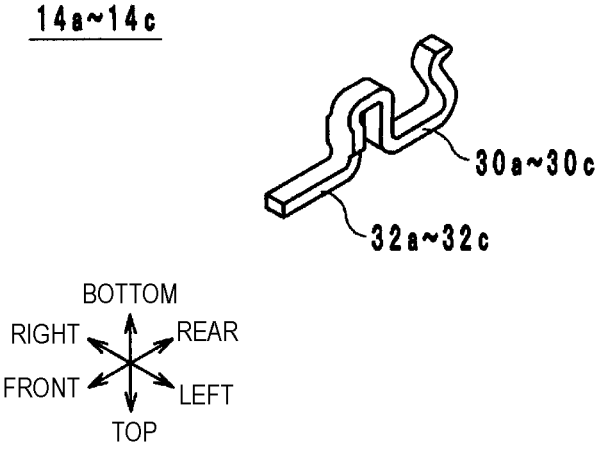
FIG. 8 is an external perspective view of each of the internal terminals according to the embodiment.

Each of the internal terminals 14*a* to 14*c* is a conductor that is connected to a signal potential or a ground potential. As illustrated in FIG. 1, the internal terminals 14*a* to 14*c* are arranged in this order from the left side and fitted into the grooves G1 to G3, respectively, of the insulating member 16. In addition, the internal terminals 14*a* and 14*c*, which are positioned at the opposite ends in the transverse direction, are each signal terminals to which a signal is applied, and the internal terminal 14*b* is a ground terminal that is connected to the ground potential. Accordingly, the internal terminals 14*a* to 14*c* are arranged such that the signal terminals and the ground terminal are alternately arranged. In addition, as illustrated in FIG. 7 and FIG. 8, each of the internal terminals 14*a* to 14*c* is fabricated by bending a single bar-shaped conductor and made of, for example, a copper-based material such as phosphor bronze. The internal terminal 14*a* can be divided into a contact portion 30*a* and a connecting portion 32*a*. The internal terminal 14*b* can be divided into a contact portion 30*b* and a connecting portion 32*b*. The internal terminal 14*c* can be divided into a contact portion 30*c* and a connecting portion 32*c*.

When the internal terminals 14*a* to 14*c* are viewed in the direction toward the right side, each of the contact portions 30*a* to 30*c* is formed in a U shape having a cavity that is open downward. The front and rear end portions of each of the contact portions 30*a* to 30*c* are bent so as to slightly extend in the depth direction.

The connecting portions 32*a* to 32*c* are connected to the front end portions of the contact portions 30*a* to 30*c*, respectively and each has an L shape when the internal terminals 14*a* to 14*c* are viewed in the direction toward the left or right side. More specifically, the connecting portions 32*a* to 32*c* extend upward from the front end portions of the contact portions 30*a* to 30*c*, respectively and are then bent so as to extend frontward. Thus, the connecting portions 32*a* to 32*c* extend frontward from the contact portions 30*a* to 30*c*, respectively. The thicknesses of upward-extending portions of the connecting portions 32*a* to 32*c* are larger than those of the other portions of the internal terminals 14*a* to 14*c*, respectively.

The multipolar connector 10, which has the above-described configuration, is mounted onto a circuit board. More specifically, the multipolar connector 10 is mounted onto the circuit board by connecting, with solder, the bending portions 24*a* and 24*b* and the connecting portions 26*a* to 26*c* to land electrodes formed on or in the circuit board.

Figure 9:
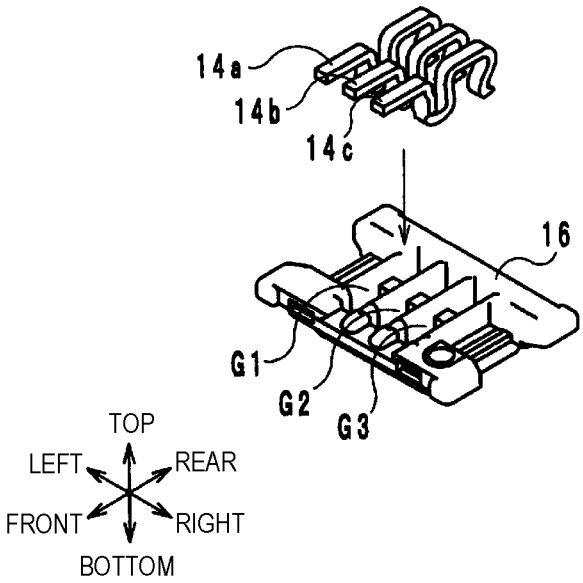
FIG. 9 is an external perspective view illustrating the order in which components of the multipolar connector according to the embodiment are assembled.
Figure 10:
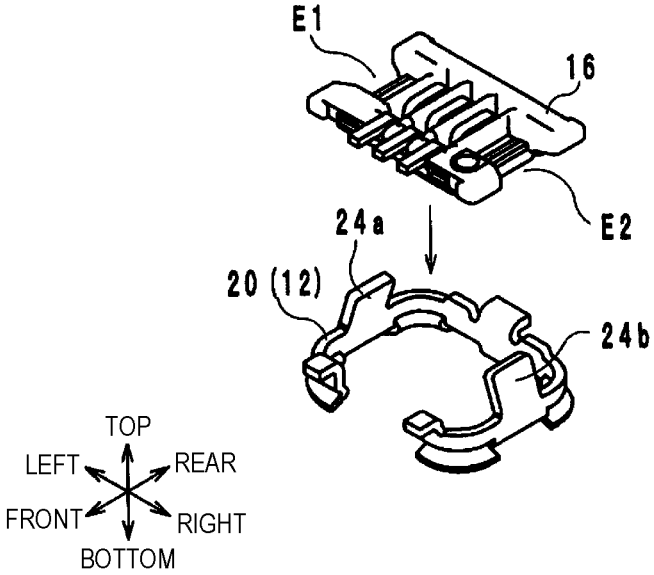
FIG. 10 is an external perspective view illustrating the order in which the components of the multipolar connector according to the embodiment are assembled.
Figure 11:
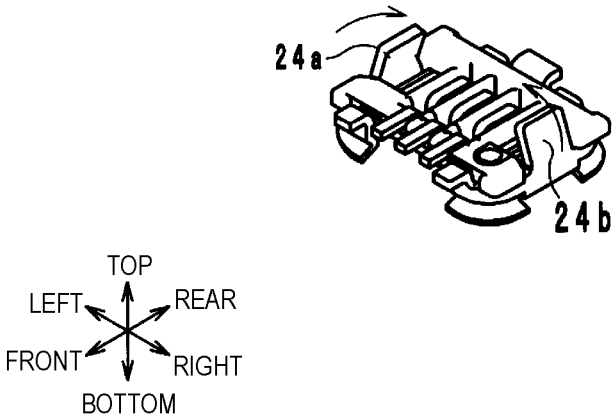
FIG. 11 is an external perspective view illustrating the order in which the components of the multipolar connector according to the embodiment are assembled.

(Assembly of Multipolar Connector, See FIG. 9 to FIG. 11)

Assembly of the multipolar connector 10 will now be described with reference to the drawings.

First, as illustrated in FIG. 9, the internal terminals 14*a* to 14*c* are inserted into the grooves G1 to G3, which are formed in the insulating member 16, from the upper side of the insulating member 16. Here, the upward-extending portions of the connecting portions 32*a* to 32*c* of the internal terminals 14*a* to 14*c* are pressed into the groove G1 to groove G3, respectively, and accordingly, the internal terminals 14*a* to 14*c* are fixed to the insulating member 16.

Next, as illustrated in FIG. 10, the insulating member 16, to which the internal terminals 14*a* to 14*c* have been fixed, is placed onto the upper end of the framework portion 21 of the outer frame portion 20 such that the bottom surface of the insulating member 16 is in contact with the outer frame portion 20 of the external terminal 12. In this case, the bending portions 24*a* and 24*b* of the external terminal 12 that project upward from the upper end of the framework portion 21 of the outer frame portion 20 when the multipolar connector 10 is viewed from above, are respectively fitted into the recesses E1 and E2, which are formed by cutting out portions of the insulating member 16 toward the inside of the insulating member 16. In addition, as illustrated in FIG. 11, the bending portions 24*a* and 24*b* pass through cutout portions that are formed in the side surfaces of the insulating member 16 in the transverse direction and project from the lower side toward the upper side of the insulating member 16.

Finally, as illustrated in FIG. 11, to-be-bent portions of the bending portions 24*a* and 24*b* projecting upward are bent toward the inside of the outer frame portion 20. As a result, the to-be-bent portions of the bending portions 24*a* and 24*b* press the top surface of the insulating member 16 downward. As a result of the bottom surface of the insulating member 16 being in contact with the upper end of the framework portion 21 of the outer frame portion 20, the insulating member 16 is restrained by the outer frame portion 20 from being displaced. As a result of the top and bottom surfaces of the insulating member 16 being sandwiched between the to-be-bent portions of the bending portions 24*a* and 24*b* of the external terminal 12 and the outer frame portion 20 of the external terminal, the insulating member 16 is fixed in place relative to the external terminal 12. Therefore, the insulating member 16 can be fixed onto the external terminal 12 by only bending the bending portions 24*a* and 24*b* of the external terminal 12 and without performing insert molding in which the insulating member 16 that is fixed to the external terminal 12 is formed by supplying a resin material to a metal mold in which the external terminal 12 is disposed. In the manner described above, manufacture of the multipolar connector 10 such as that illustrated in FIG. 1 is completed.

Figure 12:
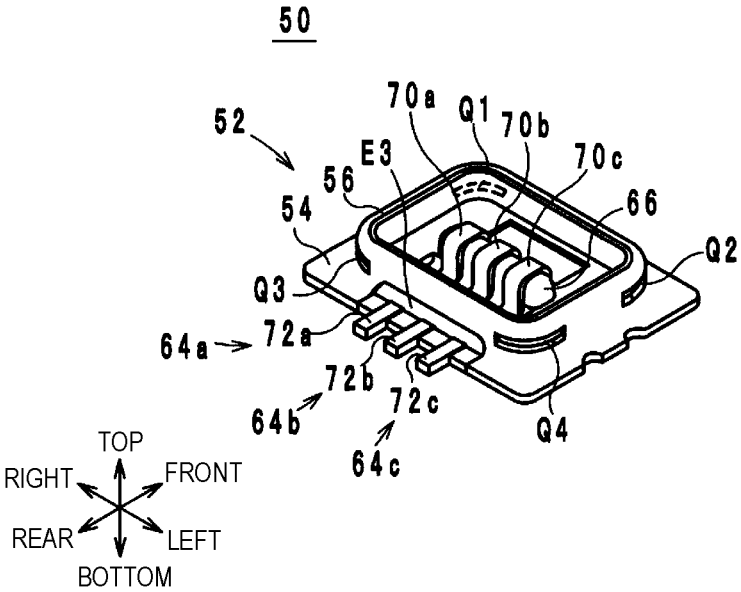
FIG. 12 is an external perspective view of another connector that is to be connected to the multipolar connector according to the embodiment.

(Configuration of Another Connector, See FIG. 12)

Another connector 50 that is connected to the multipolar connector 10 will be described below with reference to the drawings. Note that directions used for describing the other connector 50 are based on the multipolar connector 10 directions. More specifically, the vertical direction, the transverse direction, and the depth direction of the multipolar connector 10 when the multipolar connector 10 is connected to the other connector 50 match the vertical direction, the transverse direction, and the depth direction, respectively, of the other connector 50.

Similar to the multipolar connector 10, the other connector 50 is mounted onto a flexible wiring board including wiring lines or a circuit board, such as a printed circuit board, and includes an external terminal 52, internal terminals 64*a* to 64*c*, and an insulating member 66 as illustrated in FIG. 12.

The external terminal 52 is a conductor that is connected to a ground potential and is fabricated by bending a single metal plate made of, for example, phosphor bronze. In addition, the external terminal 52 can be divided into a bottom surface portion 54 that is fixed onto a circuit board or the like and an inner frame portion 56 that is connected to the multipolar connector 10.

The bottom surface portion 54 has a flat plate-like shape extending in the horizontal direction, and when the other connector 50 is viewed in the vertical direction, the bottom surface portion 54 has a rectangular shape having the front and rear long sides extending in the transverse direction. However, a portion in the vicinity of the center of the rear long side of the bottom surface portion 54 is cut out. This cutout portion E3 extends to the lower end of the inner frame portion 56, which will be described below, and the internal terminals 64*a* to 64*c* extend from the cutout portion E3.

The inner frame portion 56 is positioned substantially at the center of the top surface of the bottom surface portion 54 in the horizontal direction. In addition, the inner frame portion 56 is a belt-shaped conductor that extends around a central axis extending in the vertical direction. When the other connector 50 is viewed in the vertical direction of the inner frame portion 56, the inner frame portion 56 has an annular shape resembling a rectangle. Recesses Q1 to Q4 each extending in the horizontal direction are formed in the corners of the rectangle that is formed by the inner frame portion 56 such that each of the recesses Q1 to Q4 is located substantially at the center of the corresponding corner in the vertical direction. Note that the long sides of the rectangle formed by the bottom surface portion 54 and the long sides of the rectangle formed by the inner frame portion 56 are parallel to one another.

Each of the internal terminals 64*a* to 64*c* is a conductor that is connected to a signal potential or a ground potential. In the present embodiment, the internal terminals 64*a* and 64*c*, which are positioned at the opposite ends in the transverse direction, are each signal terminals to which a signal is applied. The internal terminal 64*b* is a ground terminal that is connected to the ground potential. Accordingly, the internal terminals 64*a* to 64*c* are arranged such that the signal terminals and the ground terminal are alternately arranged. In addition, each of the internal terminals 64*a* to 64*c* is fabricated by bending a single bar-shaped conductor and made of, for example, a copper-based material such as phosphor bronze. The internal terminal 64*a* includes a contact portion 70*a* and a connecting portion 72*a*. The internal terminal 64*b* includes a contact portion 70*b* and a connecting portion 72*b*. The internal terminal 64*c* includes a contact portion 70*c* and a connecting portion 72*c*.

The contact portions 70*a* to 70*c* are positioned in an area inside the inner frame portion 56 of the external terminal 52. In addition, when the other connector 50 is viewed in the direction toward the left or right side, each of the contact portions 70*a* to 70*c* is formed in a U shape having a cavity that is open downward.

The connecting portions 72*a* to 72*c* are connected to the rear end portions of the contact portions 70*a* to 70*c*, respectively and extend rearward. Accordingly, the internal terminals 64*a* to 64*c* extend toward the rear side of the external terminal 52 from the cutout portion E3 of the external terminal 52.

The insulating member 66 is an insulating member that is provided for the external terminal 52 and formed by performing insert molding or the like and serves to insulate the external terminal 52 from the internal terminals 64*a* to 64*c* and hold the internal terminals 64*a* to 64*c*. The insulating member 66 is shaped so as to follow the bottom surfaces of the internal terminals 64*a* to 64*c*. Note that the material of the insulating member 66 is, for example, a liquid crystal polymer.

(Mounting of Multipolar Connector onto Other Connector, See FIG. 13 to FIG. 16)

Figure 13:
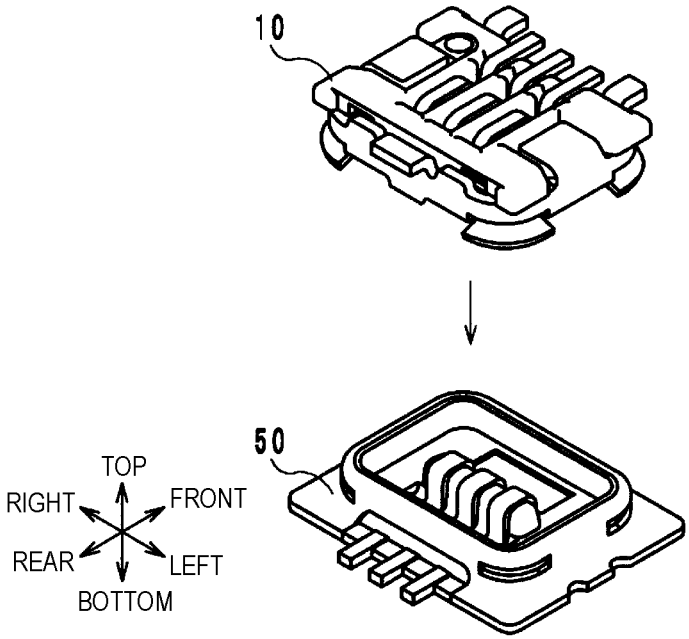
FIG. 13 is an external perspective view illustrating a method of connecting the multipolar connector according to the embodiment and the other connector to each other.
Figure 14:
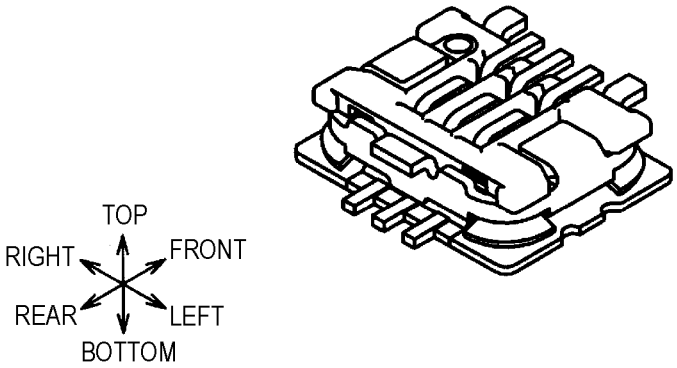
FIG. 14 is an external perspective view illustrating a state in which the multipolar connector according to the embodiment and the other connector are connected to each other.
Figure 15:
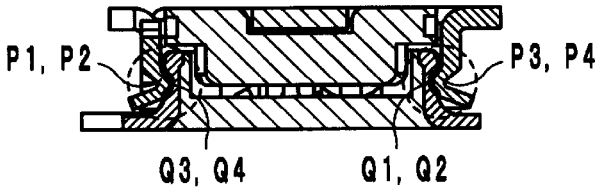
FIG. 15 is a cross-sectional view illustrating a fitted state when the multipolar connector according to the embodiment and the other connector are connected to each other.
Figure 16:
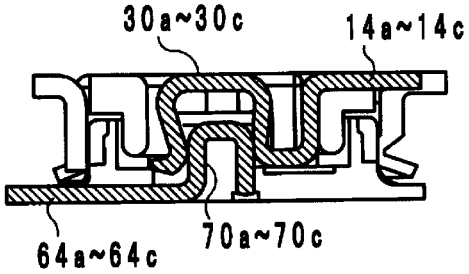
FIG. 16 is a cross-sectional view illustrating a state in which one of the internal terminals of the multipolar connector according to the embodiment and one of internal terminals of the other connector are in contact with each other.

When connecting the multipolar connector 10 to the other connector 50, as illustrated in FIG. 13, the multipolar connector 10 is pressed against the other connector 50 in a connecting direction such that the bottom surface of the multipolar connector 10 faces the top surface of the other connector 50. As a result, manufacture of a connector set such as that illustrated in FIG. 14 is completed. In this case, as illustrated in FIG. 15, the inner peripheral surface of the outer frame portion 20 of the multipolar connector 10 is brought into contact with the outer peripheral surface of the inner frame portion 56 of the other connector 50. Along with this, the projecting portions P1 to P4 of the multipolar connector 10 engage the recesses Q1 to Q4, respectively, of the other connector 50, so that the multipolar connector 10 is fixed to the other connector 50. In addition, as illustrated in FIG. 16, the contact portion 70*a* of the internal terminal 64*a* of the other connector 50 is disposed in the cavity of the contact portion 30*a* of the internal terminal 14*a* of the multipolar connector 10. The contact portion 70*b* of the internal terminal 64*b* of the other connector 50 is disposed in the cavity of the contact portion 30*b* of the internal terminal 14*b* of the multipolar connector 10. The contact portion 70*c* of the internal terminal 64*c* of the other connector 50 is disposed in the cavity of the contact portion 30*c* of the internal terminal 14*c* of the multipolar connector 10. This enables transmission of signals between the multipolar connector 10 and the other connector 50.

Advantageous Effects

In the multipolar connector 10, the insulating member 16 is placed such that the bottom surface of the insulating member 16 is in contact with the outer frame portion 20 of the external terminal 12, and the top surface of the insulating member 16 is pressed by the bending portions 24*a* and 24*b* of the external terminal 12 toward the outer frame portion 20. As a result, the insulating member 16 is fixed to the external terminal. Such a structure is simpler than that of a multipolar connector of the related art, and when performing assembly, high positional accuracy is not required for a portion of the insulating member 16 and a portion of the external terminal 12 that are to be fixed to each other.

In addition, in the multipolar connector 10, as described above, the top surface of the insulating member 16 is pressed by the bending portions 24*a* and 24*b* of the external terminal 12 toward the outer frame portion 20. This indicates that, in the multipolar connector 10, the bending portions 24*a* and 24*b* are located on the side on which a board is disposed, that is, provided on a surface of the multipolar connector 10 that is opposite to a contact surface of the multipolar connector 10 when connecting the multipolar connector 10 to the other connector 50. Therefore, when connecting the multipolar connector 10 and the other connector 50 to each other, the bent portions 24*a* and 24*b* will not be in contact with the other connector 50, and thus, it is not necessary to make the shape of the other connector 50 correspond to the bent portions 24*a* and 24*b*. In other words, by forming the bent portions 24*a* and 24*b* on the surface of the multipolar connector 10 that is opposite to the contact surface when connecting the multipolar connector 10 to the other connector 50, some leeway can be given to the shape of the other connector 50.

In addition, in the multipolar connector 10, since the bending portions 24*a* and 24*b* are provided on the side on which a board is disposed, the bending portions 24*a* and 24*b* can be utilized as portions of the multipolar connector 10 that are soldered onto a circuit board. As a result, the multipolar connector 10 can be further strongly fixed onto a circuit board compared with the case where only the connecting portions 26*a* to 26*c* are utilized as portions of the multipolar connector 10 that are soldered onto a circuit board.

As illustrated in FIG. 10, the insulating member 16 has the recesses E1 and E2 into which the bending portions 24*a* and 24*b* of the external terminal 12 are fitted when the insulating member 16 is placed on the outer frame portion 20 of the external terminal 12. In this case, when the multipolar connector 10 is viewed from above, the insulating member 16 projects outward from the outer frame portion 20. As a result of the insulating member 16 being provided so as to project outward from the outer frame portion 20 as described above, the inner periphery side of the outer frame portion 20 is covered with the insulating member 16. As a result of the inner periphery side of the outer frame portion 20 being covered with the insulating member 16, the multipolar connector 10 can be easily picked up by performing air suction. More specifically, when picking up and transporting the multipolar connector 10, an end portion of an arm of a pickup apparatus is pressed against the external terminal 12 in the vertical direction so as to suction the multipolar connector 10, and the multipolar connector 10 is transported. In this case, if there is a gap on the inner periphery side of the outer frame portion 20 when viewed in the vertical direction, air leaks from the gap when the pickup apparatus starts suctioning, and thus, it becomes difficult for the multipolar connector 10 to be suctioned onto the end portion of the arm of the pickup apparatus. However, in the multipolar connector 10, since the inner periphery side of the outer frame portion 20 is covered with the insulating member 16, air leakage is less likely to occur when the pickup apparatus performs suctioning. As a result, the multipolar connector 10 can be suctioned onto the end portion of the arm of the pickup apparatus, and the multipolar connector 10 can be easily picked up.

When the outer frame portion 20 of the multipolar connector 10 is viewed from above, the outer frame portion 20 has a partially cut-away annular shape. As a result of the outer frame portion 20 being partially cut away, the outer frame portion 20 is likely to be widened in the horizontal direction when connecting the multipolar connector 10 to the other connector 50. Therefore, even in the case where the multipolar connector 10 is pressed against the other connector 50 in a direction that is displaced from the vertical direction, the outer frame portion 20 may be widened in the horizontal direction, and thus, the multipolar connector 10 can be firmly pressed against the other connector 50.

The thicknesses of the upward-extending portions of the connecting portions 32*a* to 32*c*, which are included in the internal terminals 14*a* to 14*c*, respectively, of the multipolar connector 10, are larger than those of the other portions of the internal terminals 14*a* to 14*c*, respectively. Here, when the internal terminals 14*a* to 14*c* are inserted into the grooves G1 to G3, respectively, of the insulating member 16, the portions of the internal terminals 14*a* to 14*c* that are thicker than the other portions of the internal terminals 14*a* to 14*c* are pressed into the grooves G1 to G3, respectively. However, a clearance is formed between each of the other portions of the internal terminals 14*a* to 14*c* and a corresponding one of the grooves G1 to G3. The clearances enable the internal terminals 14*a* to 14*c* to move to some extent. Therefore, the stress that is generated when connecting the multipolar connector 10 and the other connector 50 to each other can be reduced, and the occurrence of breakage of the internal terminals 14*a* to 14*c* can be suppressed.

Other Embodiments

The multipolar connector according to the present disclosure is not limited to the above-described embodiment, and various changes can be made within the scope of the present disclosure. For example, the materials, sizes, specific shapes, and the like of the components are arbitrary. In addition, the number of the internal terminals is not limited to three and may be two or may be four or more.

INDUSTRIAL APPLICABILITY

As described above, the present disclosure is useful in a multipolar connector, and in particular, the present disclosure has an advantage of easily assembling components without requiring high positional accuracy for portions of the components that are to be fixed to each other.

The invention claimed is:

1. A multipolar connector comprising:

an insulator including an upper surface having a groove therein, a bottom surface and a side surface;

at least one internal terminal exposed in the groove; and at least one external terminal including:

an outer frame with a shape overlapping a portion of the side surface of the insulator, and a bending tab that extends through the outer frame, is bent toward the internal terminal, and extends to the bottom surface of the insulator.

2. The multipolar connector according to claim 1, wherein an edge of the bending tab is configured for soldering onto a substrate.

3. The multipolar connector according to claim 1, wherein the at least one internal terminal includes a plurality of the internal terminals disposed along the side surface of the insulator.

4. The multipolar connector according to claim 1, wherein the at least one external terminal includes a plurality of external terminals disposed at opposite ends of the insulator.

5. The multipolar connector according to claim 1, wherein the internal terminal has a portion along a protrusion of an insulator.

6. The multipolar connector according to claim 1, wherein the external terminal has a portion which extends along a direction in which the internal terminal extends.

7. The multipolar connector according to claim 1, wherein the internal terminal has a tip that is exposed away from the external terminal.

8. A multipolar connector comprising:

an insulator including an upper surface having a groove therein, a bottom surface and a side surface;

at least one internal terminal exposed in the groove; and at least one external terminal including:

an outer frame with a shape overlapping a portion of the side surface of the insulator, and a bending tab that extends through the outer frame, is bent toward the internal terminal, extends to the bottom surface of the insulator, and overlaps the upper surface of the insulator.

* * * * *